US007190106B2

(12) United States Patent
Downs et al.

(10) Patent No.: US 7,190,106 B2
(45) Date of Patent: Mar. 13, 2007

(54) SPARK PLUG WITH GROUND ELECTRODE HAVING MECHANICALLY LOCKED PRECIOUS METAL FEATURE

(75) Inventors: Darren C. Downs, Northwood, OH (US); Michael E. Garrett, Toledo, OH (US)

(73) Assignee: Federal Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/322,517

(22) Filed: Dec. 30, 2005

(65) Prior Publication Data

US 2006/0103284 A1 May 18, 2006

Related U.S. Application Data

(62) Division of application No. 10/702,378, filed on Nov. 5, 2003, now Pat. No. 7,011,560.

(51) Int. Cl.
*H01T 13/20* (2006.01)

(52) U.S. Cl. ..... 313/141; 313/118; 313/143

(58) Field of Classification Search ..... 313/118, 313/141–144

See application file for complete search history.

(56) References Cited

U.S. PATENT DOCUMENTS

| | | | | |
|---|---|---|---|---|
| 4,023,058 | A | 5/1977 | Lara et al. | 313/139 |
| 4,414,483 | A | 11/1983 | Nishio et al. | 313/136 |
| 4,670,684 | A | 6/1987 | Kagawa et al. | 313/141 |
| 4,743,793 | A | 5/1988 | Toya et al. | 313/141 |
| 4,771,210 | A | 9/1988 | Mohle et al. | 313/141 |
| 5,347,193 | A | 9/1994 | Oshima et al. | 313/141 |
| 5,493,171 | A | 2/1996 | Wood, III et al. | 313/141 |
| 5,510,667 | A | 4/1996 | Loffler et al. | 313/141 |
| 5,982,080 | A | 11/1999 | Shibata et al. | 313/141 |
| 5,998,913 | A | 12/1999 | Matsutani | 313/141 |
| 6,078,129 | A | 6/2000 | Gotou et al. | 313/141 |
| 6,337,533 | B1 | 1/2002 | Hanashi et al. | 313/141 |
| 6,346,766 | B1 | 2/2002 | Kanao et al. | 313/141 |
| 6,412,465 | B1 | 7/2002 | Lykowski et al. | 123/169 EL |
| 6,533,629 | B1 | 3/2003 | Boehler et al. | 445/7 |
| 2001/0030494 | A1 | 10/2001 | Kanao | 313/141 |
| 2001/0030495 | A1 | 10/2001 | Kanao et al. | 313/141 |
| 2002/0074920 | A1 | 6/2002 | Chiu et al. | 313/141 |

FOREIGN PATENT DOCUMENTS

| | | |
|---|---|---|
| EP | 1 139 530 A2 | 10/2001 |
| EP | 1 244 189 A2 | 9/2002 |
| WO | WO 02/065601 A1 | 8/2002 |

*Primary Examiner*—Joseph Williams
*Assistant Examiner*—Kevin Quarterman
(74) *Attorney, Agent, or Firm*—Dickinson Wright PLLC

(57) ABSTRACT

A ground electrode for a spark plug has a through hole located adjacent a firing end of the electrode, with a precious metal firing tip extending through the hole. The firing tip is compressed axially to define a bulging portion extending radially outwardly from its longitudinal axis to mechanically retain the firing tip within the through hole. The firing tip additionally has an enlarged head or otherwise expanded portion at each axial end of the tip to provide a second mechanical interlock of the tip to the ground electrode. The firing tip can then also be welded to further strengthen its connection to the ground electrode. A method of manufacturing the ground electrode and a spark plug containing the ground electrode is also disclosed.

23 Claims, 1 Drawing Sheet

SPARK PLUG WITH GROUND ELECTRODE HAVING MECHANICALLY LOCKED PRECIOUS METAL FEATURE

CROSS REFERENCE TO RELATED APPLICATIONS

This application is a divisional of application Ser. No. 10/702,378 filed Nov. 5, 2003 now U.S. Pat. No. 7,011,560. The entire disclosure of the prior application Ser. No. 10/702,378, from which a copy of the oath or declaration is supplied, is considered as being part of the disclosure of the accompanying application and is hereby incorporated by reference therein.

BACKGROUND OF THE INVENTION

Related Art

Spark plugs for use in internal combustion engines typically have a center electrode and a ground electrode with a predefined gap therebetween. It is desirable to maintain the predefined gap distance so that a predictable and repeatable spark can arc between the two electrodes. To improve the useful life of a spark plug, it is known to incorporate precious metals, i.e. iridium-based alloys, platinum alloys, or other precious metals, on the electrodes to maintain the predetermined gap and to resist erosion in use. To ensure that the precious metal maintains the desired gap, it is beneficial to secure the precious metal to the electrode such that the precious metal does not become dislodged or move from its fixed position. To further maintain the desired gap, it is desirable to maximize the surface area of the precious metal exposed to the gap. As disclosed in U.S. Pat. No. 4,771,210 to K. Möhle et al., it is known to insert an electric discharge pad or firing tip in a through bore of a ground electrode and either laser or argon arc weld the firing tip to the electrode. Further, this patent discloses applying a radial load through opposite sides of the ground electrode perpendicular to an axis of the bore to plastically deform the ground electrode inwardly toward the firing tip in a pinched fashion to capture the firing tip.

SUMMARY OF THE INVENTION

A spark plug for an internal combustion engine has a ground electrode disposed adjacent a central electrode defining a spark gap therebetween. The ground electrode has a through hole extending axially toward the center electrode at the spark gap. A firing tip having a longitudinal axis is received at least in part in the through hole and the firing tip is compressed axially along its longitudinal axis to define a bulging portion extending radially outwardly from the longitudinal axis to mechanically retain the firing tip within the through hole.

In accordance with another aspect of the invention, there is provided a spark plug and a ground electrode therefore in which a firing tip is mechanically interlocked within a through hole in the ground electrode by engagement of an enlarged head or otherwise expanded portion of the firing tip with an outer surface of the ground electrode at each end of the firing tip.

Yet another aspect of the invention provides a method of constructing a ground electrode for a spark plug. The method includes providing a segment of metal wire and forming a through hole extending between generally opposite surfaces of the wire. A firing tip having a longitudinal axis is inserted within the through hole and then compressed along its longitudinal axis to mechanically secure the firing tip within the through hole.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
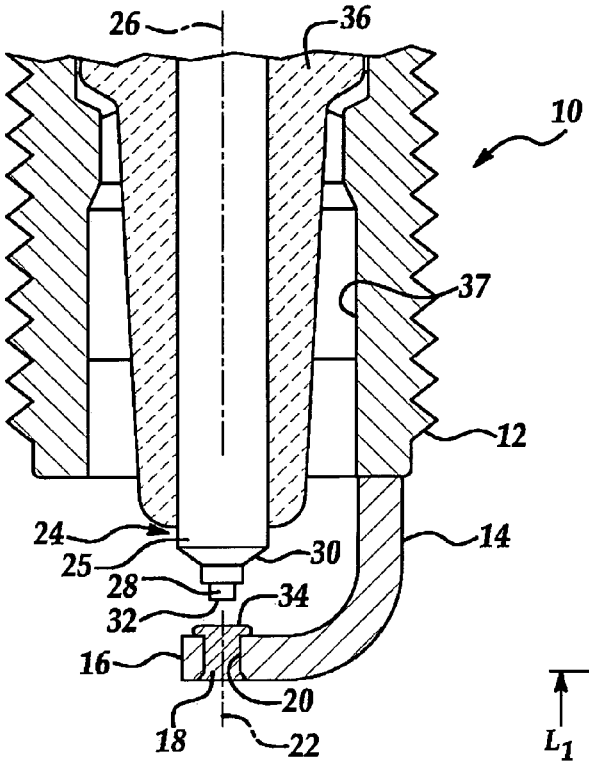
FIG. 1 is a fragmentary cross-sectioned view of a spark plug constructed according to one embodiment of the invention.

A fragmentary view of a spark plug constructed according to one presently preferred embodiment of the invention is shown in FIG. 1 generally at 10. The spark plug 10 has a metal shell or housing 12 with a ground electrode 14 extending therefrom. The ground electrode 14 is generally L-shaped and extends from a first end that is welded to shell 12 to a second free end 16. An electric discharge pad or firing tip 18 is received at least in part in a through hole 20 extending through the ground electrode 14 generally adjacent the free end 16. The firing tip 18 is mechanically retained within the through hole 20 by compressing the firing tip 18 axially along a longitudinal axis 22 to deform it radially and establish an interference fit between the firing tip 18 and the bore 20. To further secure the firing tip 18 to the ground electrode 14, the firing tip 18 is preferably welded to the ground electrode 14.

The spark plug 10 includes a number of other components that can be made and assembled in a conventional fashion. This includes a center electrode assembly 24 and insulator 36. The center electrode assembly 24 has a center electrode 25 extending along a central axis 26 of the spark plug 10 and can include additional components (not shown) such as one or more conductive, non-conductive, or resistive glass seals, capsule suppressors and an associated compression spring, as well as a terminal attached to the top end of the insulator 36. The center electrode 25 has a firing tip or electrical discharge member 28 extending from an end 30 of the center electrode 24 and terminating at a firing end 32. The firing end 32 of the center electrode firing tip 28 and an upper surface 34 of the ground electrode firing tip 18 define a spark gap of a predetermined distance. It is desirable to maintain the predetermined gap throughout the life of the spark plug 10 so that its performance will not degrade significantly. Insulator 36 is secured within a central bore 37 of the housing 12. The insulator 36 in turn includes a longitudinal bore in which center electrode assembly 24 is located.

Figure 2A:
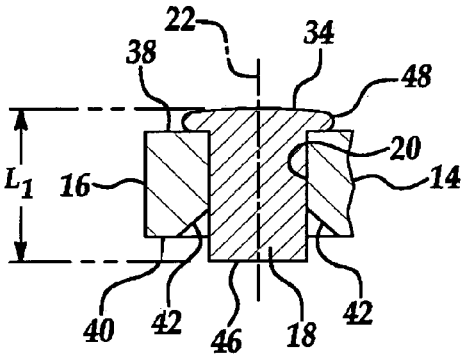
FIG. 2A is an enlarged fragmentary view of the spark plug of FIG. 1 showing a firing tip partially assembled to a ground electrode of the spark plug of FIG. 1.

As best shown in FIG. 2A, the firing tip 18 is partially assembled within the through hole 20 of the ground electrode 14. The ground electrode 14 is preferably fixed to the housing 12, such as through a resistance weld joint, and is preferably straight, and not yet bent into the L-shaped configuration shown in FIG. 1. In addition, the casing 12 and ground electrode 14 are preferably coated, for example with nickel or a nickel-based alloy, prior to inserting the firing tip 18 into the through hole 20. The ground electrode 14, has an upper surface 38 and a lower surface 40 generally parallel to one another with the through hole 20 extending between the upper and lower surfaces 38, 40. Preferably, a counterbore 42 is formed and extends from at least one of the upper and lower surfaces 38, 40, shown here as the lower surface 40 of the ground electrode 14, into the through hole 20 about 0.005–0.010". The counterbore 42 is shown having a tapered surface that is oblique relative to the upper surface 38, and preferably has a chamfer of about 15°–25° relative to axis 22, though it should be recognized other configurations may be desirable, for example a generally stepped configuration. The ground electrode 14 is preferably constructed from a nickel-based material, for example and without limitation, an Inconel or 836 alloy, and can be made with or without a copper core. With the through hole 20 formed in the ground electrode 14, the firing tip 18 is inserted within the through hole 20.

The firing tip 18 has an end 46 generally opposite the end 34 wherein a first length, represented as ($L_1$), is defined between the ends 34, 46 prior to the firing tip 18 being compressed. Preferably, the end 34 has an enlarged head 48 for abutting the upper surface 38 upon inserting the firing tip 18 into the through hole 20, which extends above upper surface 38. As shown in FIG. 2A, the end 46 of the firing tip 18 extends below the lower surface 40 of the ground electrode 14 preferably about 0.030"–0.040" prior to compressing the firing tip 18 within the bore 20.

Figure 2B:
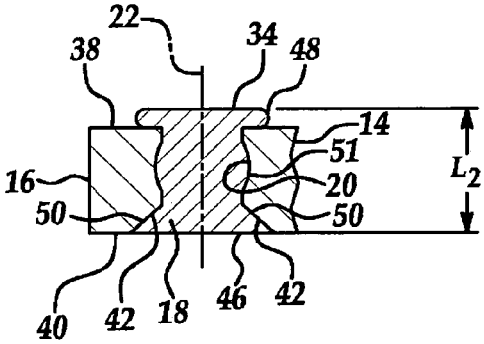
FIG. 2B is a view similar to FIG. 2A with the firing tip fully assembled to the ground electrode.

Upon inserting the firing tip 18 at least in part within the through hole 20, the head 48 is preferably maintained in contact with the upper surface 38, while the end 46 is axially compressed along the longitudinal axis 22 to define a flared portion 50 of the firing tip 18 (FIG. 2B). Preferably, the head 48 is backed-up by a generally fixed surface while compressing the end 46 of the firing tip 18 generally toward the head 48 along the axis 22. Generally, the axial force to compress the firing tip 18 is in a range of about 300 lbs.–380 lbs., and preferably within a range of 320 lbs.–360 lbs. This axial compression of the firing tip 18 expands the firing tip material at end 46 outwardly to thereby form the flared portion 50. Upon completing the compression of the firing tip 18, the firing tip 18 has a second length, wherein the second length, represented here as ($L_2$), is shorter than the first length ($L_1$) of the firing tip 18.

Preferably, the end 46 is compressed to a degree such that it is generally flush with the lower surface 40. The head 48 preferably presents an enlarged surface area having a diameter of approximately 0.120"–0.125" to further enhance maintaining the gap and thus, extending the life of the spark plug 10.

The enlarged head 48 and flared portion 50 form a first mechanical interlock. These features 48, 50 together retain the firing tip 18 in position by abutting opposing surfaces of the ground electrode. In addition to this first mechanical interlock, a bulging portion 51 is also formed during the compression operation. The bulging portion 51 is located generally between the head 48 and the flared portion 50 of the firing tip and is substantially centered longitudinally in this location (see FIGS. 2B and 3) and bulges, or extends, radially outwardly about 0.005"–0.010" on the radius. The bulging portion 51 further retains the firing tip 18 in position by creating additional interference (i.e., a second mechanical interlock) with the ground electrode 14 within the through hole 20. Either this first mechanical interlock or the second mechanical interlock, or both, can be used without departure from the scope of the invention.

Figure 3:
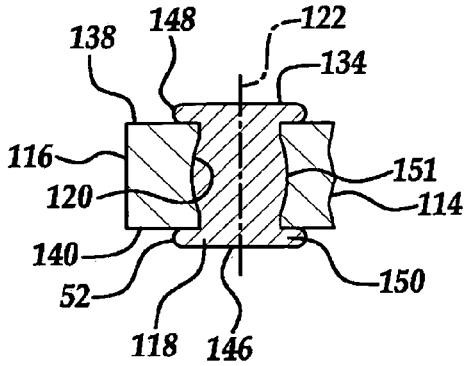
FIG. 3 is a view similar to FIG. 2B showing an alternative embodiment of the invention.

In the alternate embodiment shown in FIG. 3, similar features as the embodiment above are given similar reference numerals, but are offset by 100. A firing tip 118 is inserted within a generally straight through hole 120 and, upon being compressed, another head 52 is formed generally opposite a head 148 such that the head 52 defines a spaced or enlarged portion 150 to mechanically retain the firing tip 118 within the bore 120. Otherwise, the embodiment shown in FIG. 3 functions similarly as the embodiment of FIG. 2B and preferably includes a bulging portion 151 that extends radially into a widened center portion of through hole 120.

Upon compressing the firing tip 18, 118 within the bore 20, preferably the firing tip is welded to the ground electrode 14, 114 to provide yet another redundant interlocking of the firing tip 18 within the bore 20. Preferably, a resistance weld is used to impart a weld joint between the ground electrode 14, 114 and the firing tip 18, 118 in both the area of the head 48, 148 and the compressed or coined end 46, 146.

Other suitable welding processes may be used to impart the weld joint, for example, a laser welding process can be used to form a stitch around the head 48, 148.

Once the firing tip 18, 118 is permanently attached to the through hole 20, 120 and the ground electrode 14, 114 is attached to the spark plug shell 12, the gap can be established between the end 34, 134 of the firing tip 18, 118 and the firing end 32 of the electrical discharge member 28 by bending the ground electrode 14, 114 to the generally L-shape form. With the firing tip 18, 118 mechanically retained, the gap can be maintained and the life of the spark plug 10 can be extended in use. To further enhance the useful life of the spark plug 10, it should be recognized that the firing tip 18, 118 is constructed from materials that resist erosion, for example iridium based materials, platinum based materials, and the like.

Although disclosed embodiment of firing tip is cylindrical, it will be understood that it can have other cross-sectioned shapes, including oval or other curved shapes or rectangular or other polygonal shapes, and that in such instances the term "radial" and its other forms do not require a cylindrical or curved shape but instead refer to a direction orthogonal to longitudinal axis of the tip.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A spark plug for an internal combustion engine, comprising:

a metal outer shell having a central bore;

an insulator secured within said central bore of said shell;

a center electrode mounted in said insulator;

a ground electrode extending from said outer shell adjacent said central electrode and defining a spark gap therebetween said ground electrode having an upper surface and a lower surface and a through hole located at said spark gaps, said through hole extending between said upper and said lower surfaces; and a firing tip having a longitudinal axis, said firing tip being received at least in part in said through hole with said longitudinal axis extending towards said center electrode, and wherein said firing tip has a bulging portion substantially centered longitudinally in said through hole between said upper and said lower surfaces and extending radially outwardly from said longitudinal axis and mechanically retaining said firing tip within said through hole.

2. The spark plug of claim 1, wherein said firing tip is deformed axially along said longitudinal axis and radially at said bulging portion and said firing tip has a diameter at said bulging portion which is greater than a diameter of said firing tip adjacent said bulging portion.

3. The spark plug of claim 1, further comprising one or more weld joints between said ground electrode and said firing tip.

4. The spark plug of claim 3, wherein at least one of said one or more weld joints is a resistance weld joint.

5. The spark plug of claim 3, wherein at least one of said one or more weld joints is a laser weld joint.

6. The spark plug of claim 1, wherein said firing tip has a pair of generally opposed ends with at least one of said ends having an enlarged head abutting one of said upper surface and said lower surface of said ground electrode.

7. The spark plug of claim 6, wherein the other of said ends of said firing tip is generally flush with a respective other of said upper surface and said lower surface of said ground electrode.

8. The spark plug of claim 7, wherein the other of said ends of said firing tip has a flared portion.

9. The spark plug of claim 8, wherein said through hole includes a counterbore at the other of said ends, and wherein said flared portion engages said counterbore of said through hole.

10. The spark plug of claim 6, wherein said generally opposed ends of said firing tip both have enlarged heads abutting said upper and said lower surfaces of said ground electrode.

11. A ground electrode for a spark plug comprising:

a wire of a predetermined length having one end attached to a housing of the spark plug and having a second, free end, said wire having an upper surface and a lower surface and a through hole extending through said wire between said upper and said lower surfaces adjacent said free end; and a firing tip having a longitudinal axis with said firing tip received at least in part in said through hole, wherein said firing tip has a bulging portion substantially centered longitudinally in said through hole between said upper and lower surfaces and extending radially outwardly from said longitudinal axis mechanically retaining said firing tip within said through hole.

12. The ground electrode of claim 11, wherein said firing tip is deformed axially along said longitudinal axis and radially at said bulging portion and said firing tip has a diameter at said bulging portion which is greater than a diameter of said firing tip adjacent said bulging portion.

13. The ground electrode of claim 11, further comprising at least one weld joint between said ground electrode and said firing tip.

14. The ground electrode of claim 11, wherein said firing tip has a pair of generally opposed ends with at least one of said ends having an enlarged head abutting one of said upper surface and said lower surface of said ground electrode.

15. The spark plug of claim 14, wherein one of said ends of said firing tip is generally flush with a respective other of said upper surface and said lower surface of said ground electrode.

16. The spark plug of claim 14, wherein the other of said ends of said firing tip has flared portion.

17. The spark plug of claim 16, wherein said through hole includes a counterbore at the other of said ends, and wherein said flared portion engages said counterbore of said through hole.

18. The spark plug of claim 14, wherein said generally opposed ends of said firing tip both have enlarged heads abutting said upper and said lower surfaces of said ground electrode.

19. A spark plug, comprising:

a metal shell having a central bore;

an insulator secured to said shell within said central bore;

a center electrode assembly extending through said insulator and terminating at a firing end;

a ground electrode attached to said shell and having a free end located adjacent said firing end, said ground electrode having a through hole open at both ends thereof and located adjacent said free end; and a firing tip having a longitudinal axis extending from a first end to a second end and having an enlarged head at said first end;

wherein said firing tip is disposed within said through hole with said enlarged head extending above and engaging an upper surface of said ground electrode, said enlarged head being located opposite said firing end of said center electrode assembly to thereby define a spark gap between said enlarged head and said firing end, said firing tip having an expanded portion at said second end that engages a lower surface of said ground electrode and said first and said second ends operatively providing a first mechanical interlock of said firing tip to said ground electrode.

20. The spark plug of claim 19, wherein said firing tip has a bulging portion substantially centered longitudinally in said through hole between said upper and said lower surfaces and extending radially outwardly from said longitudinal axis and mechanically retaining said firing tip within said through hole and operatively providing a second mechanical interlock of said firing tip to said ground electrode.

21. The spark plug of claim 19, wherein said through hole includes a counterbore at said second end of said firing tip that defines an inclined outer surface of said ground electrode, and wherein said expanded portion of said firing tip comprises a flared portion that extends into said counterbore and engages said inclined outer surface.

22. The spark plug of claim 19, wherein said expanded portion of said firing tip comprises a second enlarged head.

23. The spark plug of claim 19, wherein said firing tip is welded to said ground electrode.

* * * * *